1/28/86 OR 4,566,873

United States Patent [19]

Toda

[11] Patent Number: 4,566,873

[45] Date of Patent: Jan. 28, 1986

[54] SCREW DECANTER TYPE CENTRIFUGAL CONCENTRATING MACHINE

[75] Inventor: Toshiyuki Toda, Hiroshima, Japan

[73] Assignee: Kotobuki Engineering & Manufacturing Co., Ltd., Kure, Japan

[21] Appl. No.: 594,297

[22] Filed: Mar. 28, 1984

[51] Int. Cl.[4] ..... B04B 1/20; B04B 11/02

[52] U.S. Cl. ..... 494/53; 494/56

[58] Field of Search ..... 494/53, 52, 54, 55, 494/56, 57, 58, 59, 3, 4, 42; 210/360.1, 360.2, 369, 371, 374, 375

[56] References Cited

U.S. PATENT DOCUMENTS

| | | | |
|---|---|---|---|
| 3,960,319 | 6/1976 | Brown | 494/42 |
| 4,298,159 | 11/1981 | Epper | 494/53 |
| 4,334,647 | 6/1982 | Taylor | 494/53 |
| 4,378,906 | 4/1983 | Epper | 494/54 |

OTHER PUBLICATIONS

Chem. Aug. Lech, 54(1982)Nr.12, S.1160–1162.

KHD, Centrifuge Digest No. 2, 1982.

*Primary Examiner*—Robert W. Jenkins

*Attorney, Agent, or Firm*—Wegner & Bretschneider

[57] ABSTRACT

An improved screw decanter type centrifugal concentrating machine for the type including a bowl and a screw conveyor rotatably supported within the bowl in the coaxial relation is disclosed. The screw conveyor is rotated at a different rotational speed from that of the bowl and an arrangement is made such that liquid initially supplied prior to separating, concentrated liquid and residual liquid after completion of separation are continuously supplied and discharged through the hollow space in the hollow shafts of the bowl and the screw conveyor. To properly adjust discharge rate of concentrated liquid and residual liquid from the machine or concentration of solid material in both liquids, throttle valves are disposed at the position located midway of discharge passages extending from the hollow shafts. The throttle valves are preferably designed in the form of an automatically controlled valve. Suspension to be treated is introduced into the bowl by way of guide vanes on the side wall of the bowl. After completion of separation concentrated liquid is discharged through the tubular space in the hollow shaft by way of scooping tubes or grooves and residual liquid is discharged through the cylindrical space in the hollow shaft by way of passages in a guide plate at the side end part of the screw conveyor.

5 Claims, 6 Drawing Figures

SCREW DECANTER TYPE CENTRIFUGAL CONCENTRATING MACHINE

BACKGROUND OF THE INVENTION

1. Field of the Invention

The present invention relates to a screw decanter type centrifugal concentrating machine and more particularly to an improved screw decanter type centrifugal concentrating machine for continuously treating so-called suspension containing fine solid particles in liquid with the aid of centrifugal force to separate it into concentrated liquid containing a high content of solid particles and residual liquid containing no solid particle or a very small amount of solid particles.

2. Description of the Prior Art

A hitherto known screw decanter type centrifugal concentrating machine is generally constructed such that a required number of nozzles of which bore is selectively determined are disposed at the position located in the vicinity of a deposition area at the one end of a bowl where solid particles conveyed by a screw are deposited so as to discharge deposited solid particles through the nozzles which are usually located on a side wall 3 as illustrated in FIG. 1. However, it has been pointed out as drawbacks inherent to the conventional centrifugal concentrating machine that it is possible to change a discharge rate of liquid through nozzles during operation of the machine and moreover carry out immediate adjustment in response to fluctuation in supply rate of suspension, concentration of solid particles or the like and that there is necessity for interrupting operation of the machine at every time when there occurs such a trouble that nozzles are clogged with foreign material. Another drawbacks of the conventional machine are loss in kinematic energy due to discharging of concentrated liquid and residual liquid from the circum-ference of the bowl, power loss due to blower function and air resistance caused by projections and openings for the arrangement of nozzles and liquid level adjustment during rotation of the bowl and power loss due to scattering of flowing air through openings on the outer casing of the bowl.

SUMMARY OF THE INVENTION

Thus, the present invention has been made with the foregoing drawbacks in mind and its object resides in providing an improved screw decanter type centrifugal concentrating machine which can easily adjust a ratio of flow rate of concentrated liquid to that of residual liquid in response to fluctuation in flow rate of supplied suspension, concentration of solid material or the like during operation of the machine and thereby assure a required concentration of concentrated liquid while consuming a reduced amount of power required for rotating the bowl.

To accomplish the above object there is proposed in accordance with the present invention a screw decanter type centrifugal concentrating machine which is operated by way of the steps of continuously supplying suspension through a support shaft for a bowl into the interior of the latter while it is rotating, causing solid material in suspension to be deposited on the inner surface of the bowl under the influence of centrifugal force, displacing deposited solid material toward the one end part of the bowl with the aid of a screw of which outer diameter is dimensioned appreciably smaller than the inner diameter of the bowl and which is coaxially rotated in the same direction as that of the bowl at a different rotational speed from that of the same, and continuously discharging concentrated liquid and residual liquid through the inner spaces in the horizontally extend-ing hollow shafts disposed at the one side of the bowl while adjusting a discharge rate of both concentrated liquid and residual liquid.

Other objects, features and advantages of the present invention will become more clearly apparent from reading of the following description which has been prepared in conjunction with the accompanying drawings.

BRIEF DESCRIPTION OF THE DRAWINGS

The accompanying drawings will be briefly described below.

.

DESCRIPTION OF THE PREFERRED EMBODIMENT

Now, the present invention will be described in a detail here under with reference to the accompanying drawings which illustrate a preferred embodiemnt of the invention.

Figure 1:
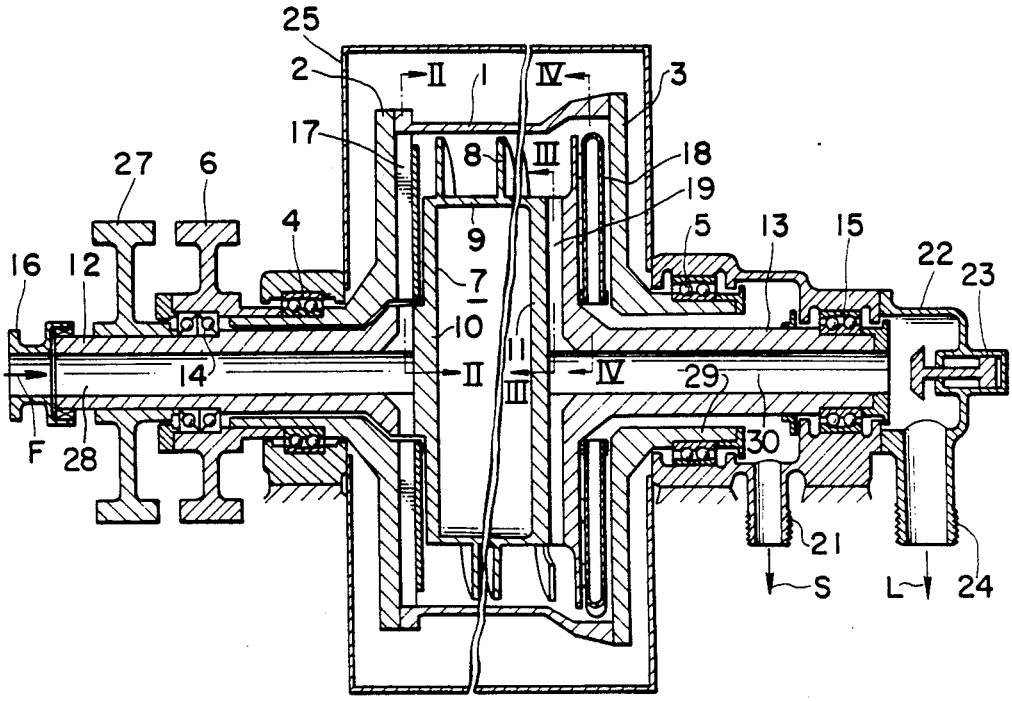
FIG. 1 is a vertical sectional view of a screw decanter type centrifugal concentrating machine in accordance with an embodiment of the invention, shown in the axially shortened state for the purpose of simplification of illustration.
Figure 2:
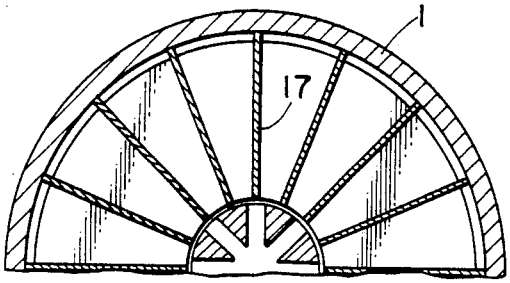
FIG. 2 is a fragmental cross-sectional view of the centrifugal concentrating machine taken in line II—II in FIG. 1.
Figure 3:
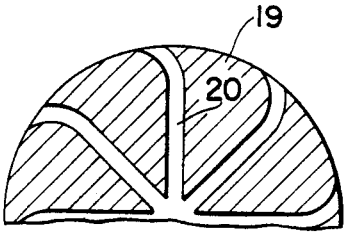
FIG. 3 is a fragmental cross-sectional view of the centrifugal concentrating machine taken in line III—III in FIG. 1.
Figure 4:
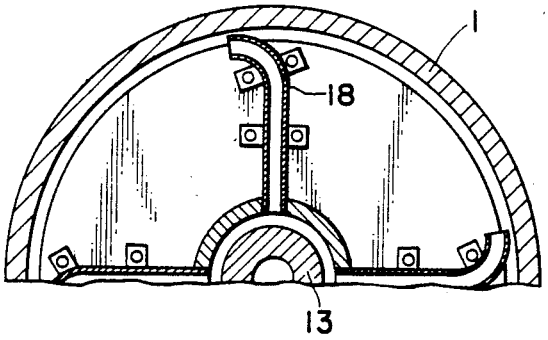
FIG. 4 is a fragmental cross-sectional view of the centrifugal concentrating machine taken in line IV—IV in FIG. 1.

Referring to FIG. 1, a horizontally extending bowl 1 has side walls 2 and 3 fixedly secured thereto. Each of the side walls 2 and 3 is made integral with a hollow shaft which is horizontally supported by means of ball bearings 4 and 5. The lefthand hollow shaft as seen in the drawing extends further through the ball bearing 4 and carries a pulley 6 at its foremost and which is fixedly mounted thereon. A screw conveyor 7 includes a cylindrical barrel 9 and a spirally extending blade 8 in the form of a screw is integrally mounted on the barrel 9. As is apparent from the drawing, the outer diameter of the blade 8 is dimensioned appreciably smaller than the inner diameter of the bowl 1. The barrel 9 has hollow shafts 12 and 13 fixedly secured to its side portions 10 and 11. The hollow shaft 12 is rotatably supported by means of ball bearings 14 firmly fitted into the pulley 6, whereas the hollow shaft 13 is rotatably supported by means of ball bearings 15. Thus, the screw conveyor 7 is horizontally supported in the coaxial relation relative to the bowl 1 with the aid of both the hollow shafts 12 and 13. The bowl 1 is rotated by the pulley 6 at a predetermined number of revolutions, whereas the screw conveyor 7 is rotated by the pulley 27 at another predetermined number of revolutions lower than that of the bowl 1.

Suspension F to be treated is introduced into the interior of the bowl 1 via an inlet port 16 attached to the foremost end of the hollow shaft 12 with a sealing member disposed on the latter, the cylindrical space 28 of the hollow shaft 12 and a plurality of radially extending guide vanes 17 on the inner surface of the side wall 2. The guide vanes 17 serve to accelerate flowing speed of suspension F to a level corresponding to rotational speed of the bowl 1 whereby turbulence of suspension in the bowl 1 can be minimized. As solid particles in suspension enter the bowl 1, they are caused to be displaced toward the inner surface of the bowl 1 under the influence of centrifugal force produced by rotation of the latter and thereafter they are conveyed toward the side wall 3 with the aid of the screw conveyor. Concentrated liquid S is scooped by a plurality of scooping tubes 18 or grooves equivalent to the scooping tubes 18 and flows through the tubular space as defined by the axial extension 29 of the side wall 3 and the hollow shaft 13 so that it is continuously discharged from a concentrated liquid outlet port 21. On the other hand, residual liquid L with no solid particle contained therein is scooped into a plurality of radially extending passages 20 on the guide plate 19 and flows through the cylindrical space 30 in the hollow shaft 13 so that it is continuously discharged from a residual liquid outlet port 24 via a residual liquid discharging device 22 disposed at the outermost end of the hollow shaft 13. Arrangement of the scooping tubes 18 and the guide plate 19 made in that way makes it possible to recover kinematic energy carried by concentrated liquid S and residual liquid L in the bowl 1 to be utilized as a part of rotational force required for rotating both the screw conveyor and the bowl. The discharging device 22 is provided with a hydraulically operated throttle valve 23 of which opening is adjusted such that a volumetric ratio of concentrated liquid to residual liquid, that is, concentration of solid particle in concentrated liquid and residual liquid is maintained within a predetermined range.

Figure 5:
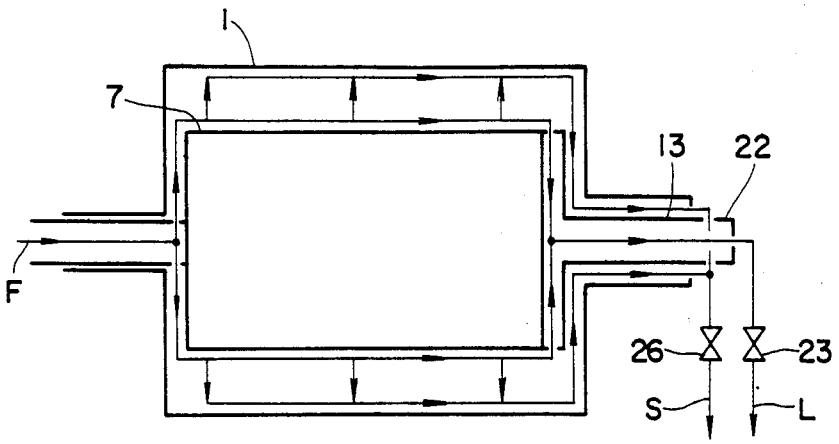
FIG. 5 is a schematic sectional view of the centrifugal concentrating machine illustrating flow lines in the centrifugal concentrating machine of the invention.

FIG. 5 schematically illustrates flowing of liquid and displacement of solid material as described above with reference to FIG. 1. As shown in FIG. 5, a throttle valve 26 adapted to be adjusted from the outside is disposed at the position located outwardly of the concentrated liquid outlet port 21 in order that concentration and flow rate of concentrated liquid are maintained within a predetermined range. These throttle valves may be designed in the form of an automatically controlled valve. By employing automatically controlled valves it is possible to automatically operate the centrifugal concentrating machine of the invention while adjustment is made in dependence on flow rate or concentration of initial liquid prior to separating.

Another advantageous feature of the centrifugal concentrating machine of the invention is that power required for rotating the machine can be reduced.

In general, power consumed for operating the centrifugal concentrating machine can be expressed by the following equation on the assumption that positional energy and kinematic energy of supplied liquid are neglected.

$$P = P_o + (1+\eta)(Q_1E_1 + Q_2E_2)$$

where P is total consumed power, $P_o$ is power consumed at a time when the machine is not loaded, that is, when no liquid is supplied, $Q_1$ is discharge rate of concentrated liquid, $E_1$ is kinematic energy carried by concentrated liquid, $Q_2$ is discharge rate of residual liquid, $E_2$ is kinematic energy carried by residual liquid and $\eta$ is inside loss coefficient.

As will be readily understood from the above equation, total consumed power is reduced when kinematic energy $E_1$ of concentrated liquid and kinematic energy $E_2$ of residual liquid are kept to a lower level, provided that $Q_1$ and $Q_2$ are constant. Accordingly, kinematic energy of discharged liquid is in proportion to square of peripheral speed as measured at the discharge position. Since the machine of the invention is constructed such that the discharge position is located closer to the axis of rotation than that of the conventioal machine, kinematic energy required for the former can be reduced and therefore consumed power can be reduced remarkably. Further, since the machine of the invention employs a bowl which has no projection and recess or opening on the side walls and the peripheral surface and therefore it is simple and flat in structure, resistance caused by air is reduced and no blower function is recognized. Moreover, since the bowl is fully housed in an airtight housing 25, scattering of flowing air into the environment is completely inhibited, resulting in no occurence of power loss due to scattering of flowing air.

Figure 6:
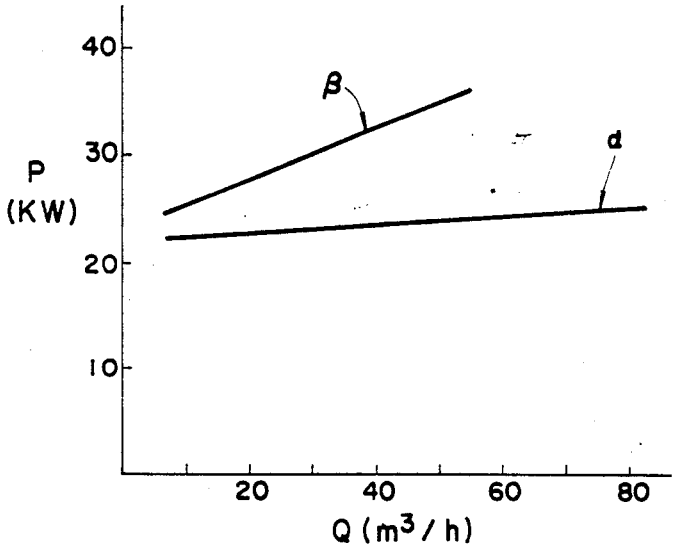
FIG. 6 is a graph comparatively illustrating performance of both the centrifugal concentrating machine of the invention and the conventional one particularly with respect to electric power consumed for their rotation.

Incidentally, FIG. 6 comparatively illustrates characteristics of the centrifugal concentrating machine of the invention (having a bowl diameter of 90 cm, a bowl length of 250 cm to be rotated at 1,000 r.p.m.) and those of the conventional one which is designed in the same dimensions to be rotated at the same number of revolutions particularly in respect of power required for rotation. As liquid to be treated excessive activated sludge is used. In the drawing abscissa represents supply rate Q ($m^3$/hr) of activated sludge and ordinate does consumed electric power P (KW). In FIG. 6 reference symbol $\alpha$ represents a characteristic line of the machine of the invention and reference symbol $\beta$ does that of the conventional machine. As is apparent from the drawing, the machine of the invention consumes an amount of electric power less than that of the conventional one. Further, since the machine of the invention has an area of deposition larger than that of the conventional one designed in the same dimensions, a supply rate of liquid to be treated can be increased in proportion to an area of deposition and therefore electric power consumed by the machine of the invention per unit volume of supplied liquid can be reduced correspondingly. Accordingly, it can be concluded that the machine of the invention is designed in the so-called energy saving type.

As described above, the screw decanter type centrifugal concentrating machine of the invention makes it possible to adjust discharge rate of concentrated liquid and residual liquid or concentration of solid material contained in both liquids discharged from the machine during its operation. Further, another advantageous features of the invention are that electric power required for operation of the machine is consumed less than the conven-tional one designed in the same dimensions and moreover electric power consumed by the machine of the invention per unit volume of supplied liquid is reduced considerably lower than that of the conventional one.

While the present invention has been described above only with respect to a single preferred embodiment, it should of cource be understood that it should not be limited only to this but various changes or modifications may be made in a suitable manner without departure from the spirit and scope of the invention.

What is claimed is:

1. A screw decanter type centrifugal concentrating machine of the type including a bowl having side walls and a screw conveyor rotatably supported within said bowl in the coaxial relation relative to the latter by means of hollow shafts fixedly secured to both of said side walls of said bowl, said screw conveyor being rotated at a different rotational speed from that of the bowl, characterized in that liquid initially supplied prior to separating, concentrated liquid and residual liquid after completion of separation in the bowl are continously supplied and discharged through the hollow space in the hollow shafts of the bowl and the screw conveyor and that throttle valves are disposed in the discharge passages extending from the hollow shaft for at least one of concentrated liquid and residual liquid.

2. A screw decanter type centrifugal concentrating machine as defined in claim 1, characterized in that liquid initially supplied prior to separating is introduced into the interior of the bowl by way of guide vanes fixed to said bowl or said screw conveyor.

3. A screw decanter type centrifutal concentrating machine as defined in claim 1, characterized in that residual liquid after completion of separation in the bowl is discharged through the cylindrical space in the hollow shaft by way of passages in a guide plate at one of said side walls of said bowl or said screw conveyor.

4. A screw decanter type centrifugal concentrating machine as defined in claim 1, characterized in that concentrated liquid after completion of separation in the bowl is discharged through the tubular space in the hollow shaft by way of scooping tubes or grooves equivalent to said scooping tubes at one of said side walls of said bowl or said screw conveyor.

5. A screw decanter type centrifugal concentrating machine as defined in claim 1, characterized in that throttle valves disposed at the position located midway of the discharge passages extending from the hollow shaft for at least one of concentrated liquid and residual liquid are designed in the form of an automatically controlled valve.

* * * * *